US006596101B2

(12) United States Patent
Weihs et al.

(10) Patent No.: US 6,596,101 B2
(45) Date of Patent: Jul. 22, 2003

(54) HIGH PERFORMANCE NANOSTRUCTURED MATERIALS AND METHODS OF MAKING THE SAME

(75) Inventors: Timothy P. Weihs, Baltimore, MD (US); Robert Cammarata, Columbia, MD (US); Chia-Ling Chien, Baltimore, MD (US); Changhe Shang, Baltimore, MD (US)

(73) Assignee: Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/970,402

(22) Filed: Oct. 3, 2001

(65) Prior Publication Data

US 2002/0069944 A1 Jun. 13, 2002

Related U.S. Application Data

(60) Provisional application No. 60/237,732, filed on Oct. 5, 2000.

(51) Int. Cl.[7] ..... C21D 8/00; C22C 38/10; C22C 38/12

(52) U.S. Cl. ..... 148/442; 148/320; 148/300; 148/120; 148/121; 148/122; 148/545; 148/651; 148/538

(58) Field of Search ..... 148/120, 121, 148/122, 300, 320, 442, 538, 540, 545, 651; 420/127, 581

(56) References Cited

U.S. PATENT DOCUMENTS

| | | | |
|---|---|---|---|
| 5,514,349 | A | 5/1996 | Parker et al. |
| 5,589,011 | A | 12/1996 | Gonsalves |
| 5,984,996 | A | 11/1999 | Gonsalves et al. |
| 6,270,347 | B1 | 8/2001 | Webster et al. |

*Primary Examiner*—Deborah Yee
(74) *Attorney, Agent, or Firm*—Lowenstein Sandler PC

(57) ABSTRACT

Preferred embodiments of the invention provide new nanostructured materials and methods for preparing nanostructured materials having increased tensile strength and ductility, increased hardness, and very fine grain sizes making such materials useful for a variety of applications such as rotors, electric generators, magnetic bearings, aerospace and many other structural and nonstructural applications. The preferred nanostructured materials have a tensile yield strength from at least about 1.9 to about 2.3 GPa and a tensile ductility from at least 1%. Preferred embodiments of the invention also provide a method of making a nanostructured material comprising melting a metallic material, solidifying the material, deforming the material, forming a plurality of dislocation cell structures, annealing the deformed material at a temperature from about 0.30 to about 0.70 of its absolute melting temperature, and cooling the material.

18 Claims, 9 Drawing Sheets

HIGH PERFORMANCE NANOSTRUCTURED MATERIALS AND METHODS OF MAKING THE SAME

CROSS REFERENCE TO RELATED APPLICATIONS

This application claims the benefit of U.S. Provisional Application Serial No. 60/237,732 filed by C. H. Shang et al. on Oct. 5, 2000 and entitled "High Performance Nanostructured Materials and Methods of Making the Same", which is incorporated herein by reference.

GOVERNMENT INTEREST

The United States Government has certain rights in this invention pursuant to Contract Number N00014-98-10600 supported by ONR.

BACKGROUND

Nanostructured materials are of considerable interest due to their unique mechanical properties and structural versatility. Materials with grain sizes less than one micrometer have been shown to have significantly improved mechanical properties compared to corresponding coarse-grained materials under certain conditions. However, the structure of the starting materials, physical treatments, and fabrication conditions can significantly impact the performance of nanostructured materials for specific applications.

Nanostructured materials with high yield strength, hardness, and superplasticity have previously been fabricated. However, poor ductility was observed to accompany these mechanical characteristics especially in high-strength intermetallic compounds. Previously, available nanostructured intermetallics failed in the elastic regime under tensile stresses with virtually no plastic strain-to-failure at room temperature, severely limiting their use in industrial applications. The observed extreme brittleness in nanostructured materials, in particular intermetallics, is attributed to flaws or porosity produced during the fabrication process.

Fabrication of nanostructured materials commonly followed a "two-step" consolidation method, which involves synthesizing various powders of nanometer size and then consolidating them into bulk articles using such processes as hot pressing. However, the "two step" consolidation processes cannot prevent the formation of micro-flaws or porosity in the final products.

"One step" methods of nanostructured synthesis (e.g., electro-deposition, crystallization of amorphous solids, and severe plastic deformation) produce materials without residual porosity, but have several disadvantages. First, nanostructured intermetallics made by these methods are extremely brittle. Second, it is difficult to electro-deposit bulk nanostructured intermetallics because of the accumulation of deposition stresses. Thus, known one-step methods of nanostructured synthesis fail to produce materials having both high tensile strength and ductility.

The problem of poor ductility in nanostructured materials is widely recognized in the scientific community. For example, the highest reported strength for nanostructured FeAl intermetallic was found to be 2.3 GPa. However, the material exhibited such poor ductility that the strength was only measurable under compression. In addition, forming bulk amorphous solids is technically complex and not practical for single-phase metallic materials. Single phase solids can be simpler to make, more stable, and may be desirable due to their magnetic, electrical, or optical properties. However single-phase intermetallics have not shown a combination of high strength and good ductility in tension.

Decreasing the grain size is important for increasing strength, but grain size should be decreased while reducing or eliminating the flaws (cracks) and porosity in the materials. Achieving fine grain sizes using severe plastic deformation involving enormous strains by torsion of several hundred percent has met with very limited success in the improvement of tensile ductility. For instance, heterogeneous strain of ~400% at 200° C., followed by homogeneous strain of ~800% at 400° C., and by additional strain of ~400% at 200° C., produces grain sizes of only approximately 1.2 micrometers for Al—Mg—Li—Zr alloys.

Tempering can be used to enhance the toughness of a hardened martensitic phase by converting the metastable martensite to a structure of fine carbide particles in ferrite. However, the tempering process results in materials with enhanced hardness but low ductility.

SUMMARY OF THE INVENTION

Preferred embodiments of the invention provide new nanostructured materials and methods for preparing nanostructured materials having increased tensile strength and ductility, increased hardness, and very fine grain sizes making such materials useful for a variety of applications such as rotors, electric generators, magnetic bearings, aerospace and many other structural and nonstructural applications. The preferred nanostructured materials have tensile yield strengths from at least about 1.5 to about 2.3 GPa and a tensile ductility from at least 1%.

Preferred embodiments of the invention also provide a method of making a nanostructured material comprising melting a metallic material into a liquid state, solidifying the material, deforming the material, forming a plurality of dislocation cell structures, annealing the deformed material at a temperature from about 0.30 to about 0.70 of the material's absolute melting temperature, and cooling the material.

Advantages of the invention will be set forth in part in the description that follows, and in part will be obvious from the description, or may be learned through the practice of the invention. The advantages of the invention will be attained by means of the instrumentalities and combinations particularly pointed out in the appended claims.

BRIEF DESCRIPTION OF THE DRAWINGS

The foregoing summary and the following detailed description of the preferred embodiments of the invention should be read in conjunction with the accompanying drawings, in which.

DETAILED DESCRIPTION

Preferred embodiments and applications of the invention will be described below. Other embodiments may be realized and structural or logical changes may be made to the embodiments without departing from the spirit or scope of the invention. Although the preferred embodiments disclosed herein have been particularly described as applied to a cold-rolled nanostructured material (and methods for producing the same), it should be readily apparent that the invention may be embodied in any composition (or method for producing the same) having the same or similar problems.

In accordance with preferred embodiments of the invention, nanostructured materials are provided having a unique combination of ultrahigh tensile yield strength and large tensile ductility. The nanostructured materials may be formed from any suitable material including, but not limited to pure metals (e.g., copper, nickel, iron), alloys, and intermetallic compounds (i.e., a particular chemical compound based on a definite atomic formula).

Figure 5:
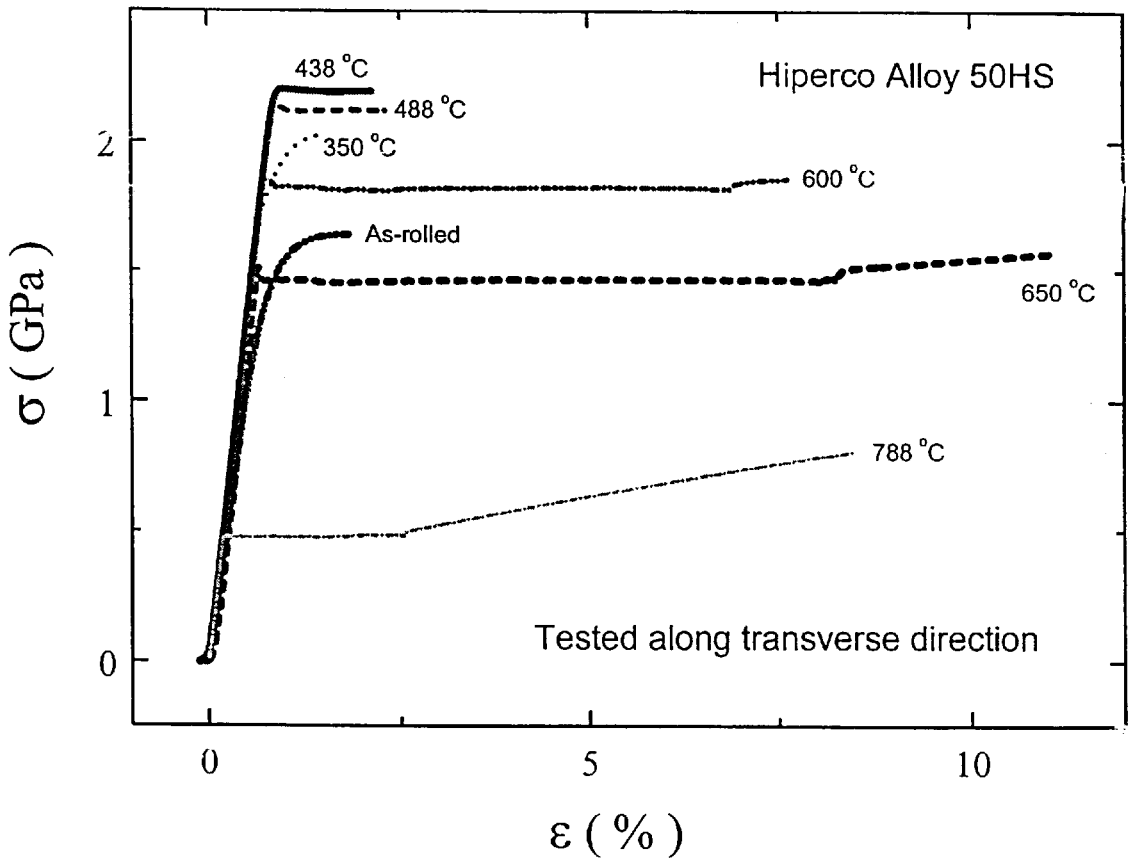
FIG. 5 shows the results from room temperature tensile tests for nanocrystalline FeCo-based intermetallics.

In accordance with a preferred embodiment, the nanostructured material has microstructures with a grain size ranging from about 10 nanometers to about 900 nanometers. The tensile yield strength of the nanostructured materials in accordance with a preferred embodiment of the invention is at least about 1.5 GPa, while the plastic strain-to-failure ratio is at least 1%. The precise mechanical properties desired can be achieved through controlled heat treatment in accordance with a preferred embodiment of the invention, as shown in FIG. 5. Increased yield strengths may be as large as about 45% compared to the "as-rolled" condition. At the same time, the tensile ductilities are greatly increased due to the formation of flaw-free nanostructured materials.

The nanostructured materials in accordance with preferred embodiments of the invention are fully dense and free of flaws and porosity. "Fully dense" refers to materials that are have a density within 0.1% of their theoretical density. "Free of flaws and porosity" refers to materials that have less 0.1 vol % pores and no cracks at grain boundaries. "Controlled heat treatment" or annealing of deformed starting materials refers to heating the specimen in a controlled atmosphere with prescribed heat-up and ramp-down temperature rates and time periods, resulting in the formation of small, nanometer scale grains.

In a preferred embodiment, the intermetallic compounds are single-phase alloys which form highly ordered crystalline materials. The preferred intermetallic compounds used to make the materials, (hereinafter referred to as "starting material"), in accordance with preferred embodiments of the invention include a base material to which certain percentages of other elements may optionally be added. Preferred intermetallic compounds, for example, may include the FeCo-based intermetallic Hiperco Alloys 50 and 50HS, available from Carpenter Technology Inc. and described in U.S. Pat. No. 5,501,747, which is hereby incorporated by reference herein in its entirety. The chemical composition of the Hiperco Alloys in weight percent is:

| Alloy Element | Composition in weight percent |
|---|---|
| C | 0.003–0.02 |
| Mn | 0.10 max. |
| Si | 0.10 max. |
| P | 0.01 max. |
| S | 0.003 max. |
| Cr | 0.1 max. |
| Ni | 0.2 max. |
| Mo | 0.1 max. |
| Co | 48–50 |
| V | 1.8–2.2 |
| Nb | 0.03–0.5 |
| N | 0.004 max. |
| O | 0.006 max. |

with iron as a balance.

Figure 2:
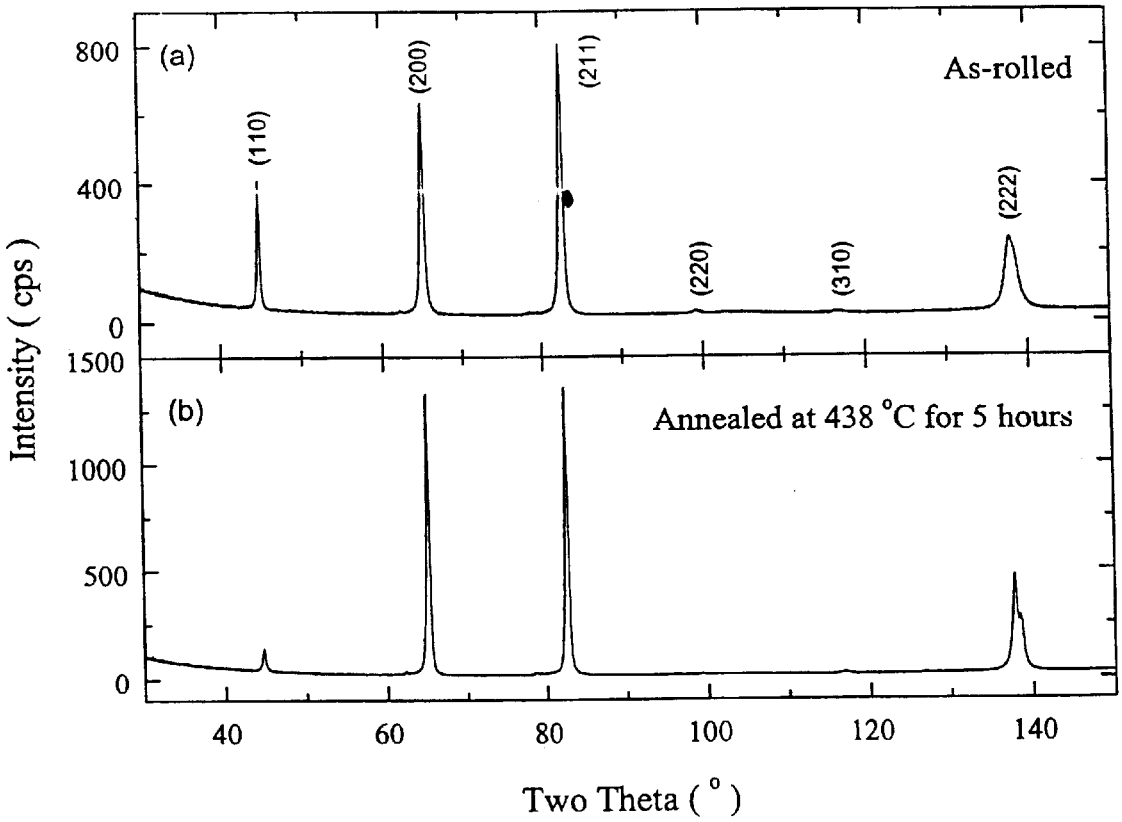
FIG. 2 shows X-ray diffraction profiles for Hiperco Alloy 50HS: (a) as-rolled, and (b) annealed at 438° C. for five hours. The inset shows the discontinuous ring diffraction pattern. The clusters of diffraction spots are evidence for the growth of subgrains with low-angle grain boundaries.

In a preferred embodiment, plastic deformation is performed using a cold-rolling process, as described generally in U.S. Pat. No. 5,501,747, to achieve a reduction ratio typically from between about 50% to about 95%. In a preferred embodiment, the reduction ratio is at least 80%, and preferably more than 90%. The annealing temperature ranges from about 0.30 to about 0.70 of the material's absolute melting temperature for time periods ranging from less than about one hour to more than about 100 hours. The annealing can be conducted in a variety of atmospheres (e.g., hydrogen, argon, and nitrogen, air, etc.) as an application requires. Following annealing, the material is cooled at a cooling rate that can vary from less than about 1° C./minute to more than about 500° C./s. This process produces nanostructured materials having ultrafine grains with grain sizes from tens to hundreds of nanometers without noticeable grain growth when used at temperatures below the annealing temperature. Furthermore, the preferred nanostructured materials have the same crystal structure before and after heat treatment, as shown in FIG. 2, demonstrating that the phase structure remains the same, and that the acquired improved properties are due to microstructural improvements.

In a preferred embodiment, a method of producing nanostructured materials is provided by forming grains of nanometer size in the heavily deformed bulk articles through controlled heat treatments. Dislocation cell structures, ordering domains, and other chemical or phase defects act as driving forces to form nanometer-sized grains. Recrystallization and grain growth are employed to develop nanostructured microstructures of diversified grain sizes The properties of nanostructured materials depend sensitively on the grain sizes. Varying grain sizes permits one to tailor the tensile strength and ductility to meet particular needs of the material. The heat treatments can be conducted for a controlled period of time at a wide range of temperatures to drive the recovery and recrystallization processes. The preferred annealing temperature is generally between 0.30 and 0.70 of the absolute melting temperature (250° C.–950° C. for Hiperco Alloys 50HS) with an annealing time from 1000 hours to several seconds. More preferred is an annealing temperature in the range 0.37–0.53 of the absolute melting temperature with an annealing time from 50 hours to several minutes. The most preferred annealing temperature is from 0.39–0.44 of the absolute melting temperature with the annealing time ranging from 20 hours to about one hour. Recrystallizing plastically deformed ingots through controlled heat treatments results in nanostructured metals, alloys, and high strength intermetallics that are fully dense and free of flaws or porosity.

Grain size can be limited to less than about one micrometer by controlling the annealing temperature and time in accordance with a preferred embodiment of the invention. The controlled annealing process results in the release of energy as the defects in the material are eliminated.

Figure 1:
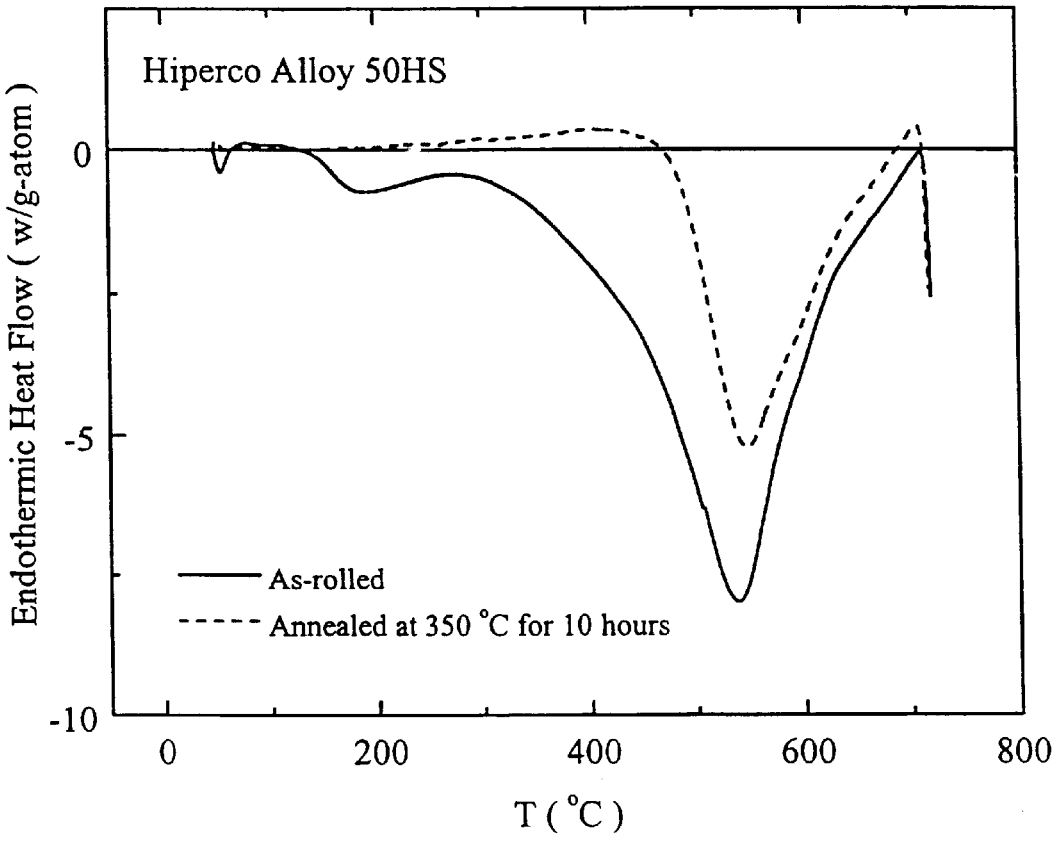
FIG. 1 shows differential scanning calorimetry traces of as-rolled and annealed Hiperco Alloy 50HS, measured at a heating rate of 40° C. per minute.

FIG. 1 is a Differential Scanning Calorimetric ("DSC") scan of Hiperco Alloy 50HS showing the endothermic heat flow as a function of temperature in comparing the "as-rolled" condition of the Hiperco Alloy to its condition after annealing. As shown in FIG. 1, the major recovery and recrystallization process of the Hiperco Alloy 50HS material occurs from between about 350 to about 705° C. Since FeCo 50HS melts at 1470° C., these temperatures correspond to 0.36 to 0.56 of the material's absolute melting temperature of 1743 Kelvin. A DSC scan is one of many tools known in the art that may be used to determine the temperature range of the recovery and recrystallization process for any given starting material. The process of cold-rolling deformation and subsequent controlled recrystallization may be repeated one or more times to obtain still finer grains and higher mechanical strengths.

In accordance with a preferred embodiment, nanostructured materials contain niobium carbide (NbCx) particles as retarders for grain growth. Compared with the more than 99 wt % major phase, however, these second phase particles occupy only a small portion in volume. Microalloying elements such as Nb contained in the nanostructured material preferably impede grain growth by nucleating particles at grain boundaries or by Nb atoms preferentially segregating to grain boundaries to act as a grain refiner. The use of Nb in the nanostructured materials is a preferred method of maintaining the structural stability of the materials.

It is to be understood that the application of the invention to a specific problem or environment will be within the capabilities of one having ordinary skill in the art in light of the teachings contained herein. The following examples further illustrate preferred embodiments of the invention.

EXAMPLE 1

Nanostructured Materials with Tensile Strength Between 1.9 and 2.3 GPA and Plastic Strain-to-failure Between 1.3% and 5.5%

Hiperco Alloy 50HS (Co 48.68%, V 1.89%, Nb 0.31%, C 0.01%, Ni 0.11%, Mn 0.04%, Si 0.03%, Cr 0.05%, and balanced with Fe) was cold-rolled to 152.4 micrometers after rolling reduction of 92.6%. The cold-rolled sheets were annealed in an ultrahigh purity hydrogen atmosphere at a temperature of 438° C. for five hours. The ramping rate was 2–3° C./minute. To establish ordered intermetallic structures that possess superior soft magnetic properties, the cooling rate after annealing was set at 1° C./min to 316° C. Based on the examination results of differential scanning calorimetric, cross-section high-resolution field emission electron microscopy, and transmission electron microscopy the nucleation period of the recrystallization process was largely completed after the above heat treatment, and the cold-rolled alloys were successfully transformed into nanostructured materials.

The grain sizes of the above processed nanostructured materials ranged from tens to hundreds of nanometers, with an average grain size of about 99 nanometers. The lower yield strengths ranged from 1.9 GPa to more than 2.3 GPa depending on the test orientation with respect to the rolling direction. The plastic strain-to-failure was 1.3% to more than 5.0% depending on the loading direction. The in-plane Vickers hardness was as high as 6.4 GPa.

EXAMPLE 2

Nanostructured Materials with Tensile Strength Between 1.3 and 1.5 GPA and Ductility Between 11% AND 18%

Hiperco Alloy 50HS alloy sheets were annealed at 650° C. for one hour. The other conditions were the same as those in EXAMPLE 1. The average grain sizes of these samples were 287 nanometers. The lower yield strengths ranged from 1.3 GPa to more than 1.5 GPa depending on the test orientation with respect to the rolling direction. The strain-to-failure was 11% to more than 18% depending on the loading direction.

EXAMPLE 3

Figure 3:
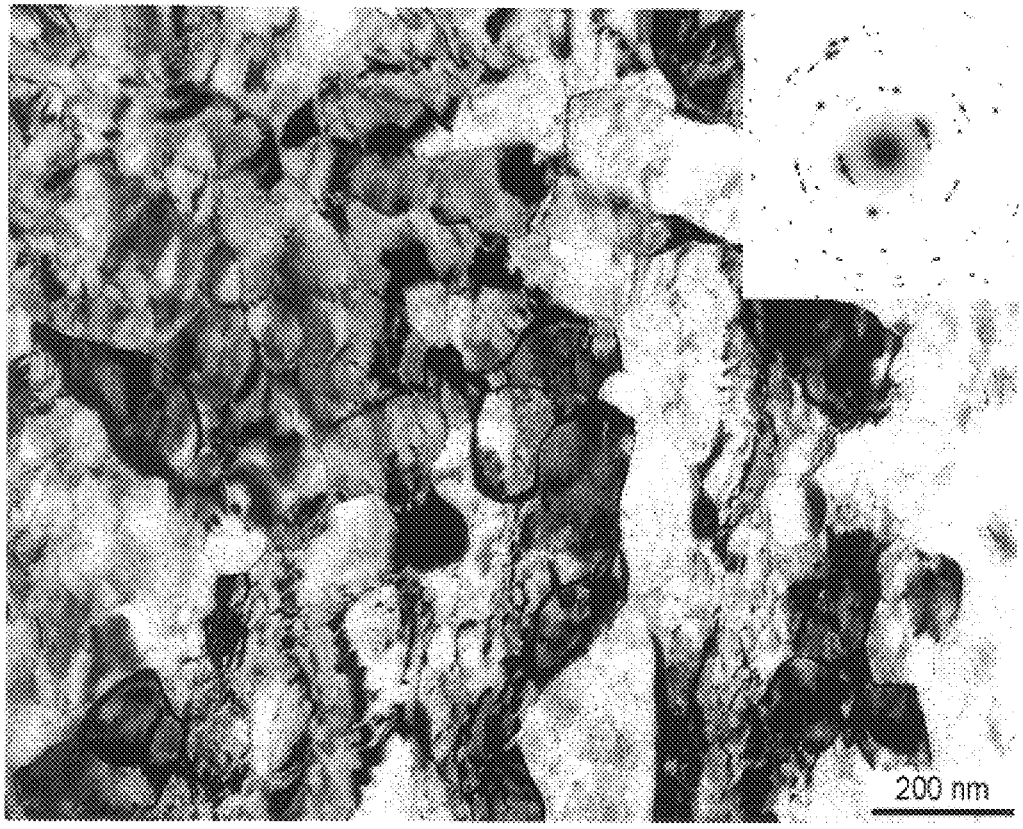
FIG. 3 is an image of a nanocrystalline FeCo-based intermetallic material taken by transmission electron microscopy, showing grain size ranging from tens to hundreds of nanometers of nanostructured material.
Figure 4:
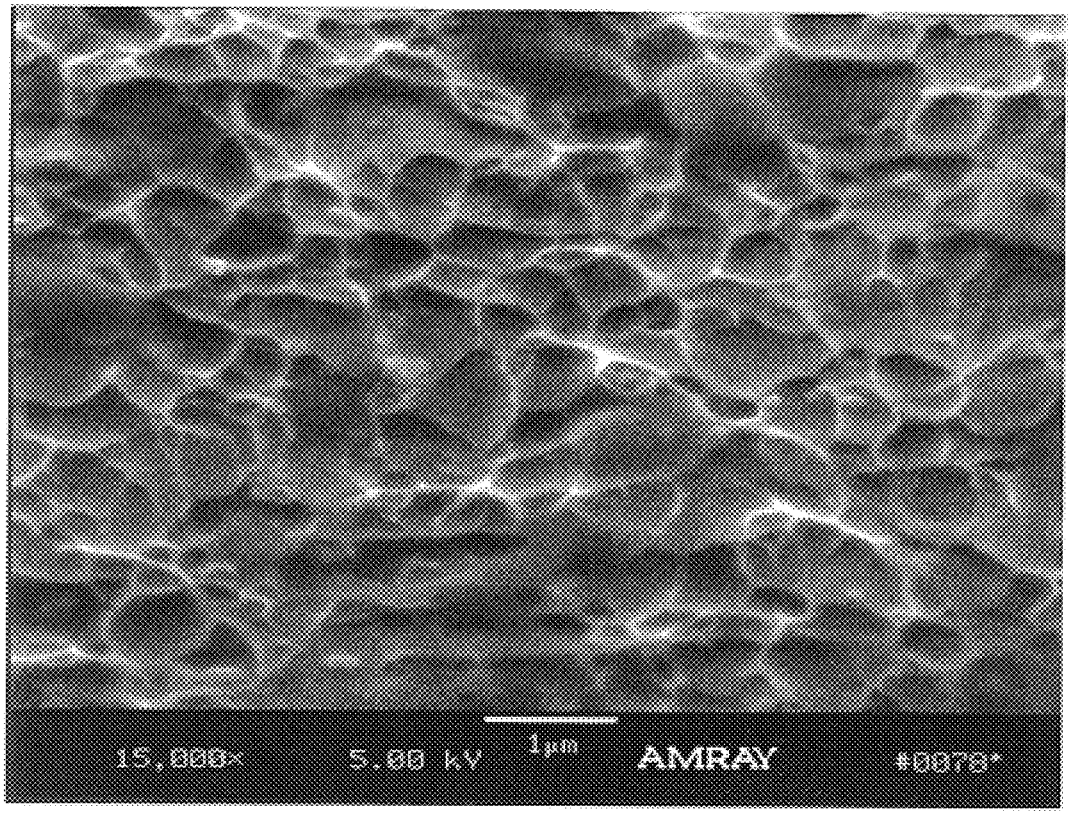
FIG. 4 is an image of a fracture surface for a nanocrystalline FeCo-based intermetallic with submicron dimples clearly showing the fracture is ductile.

Nanostructured Intermetallic Materials with Fine Grain Size and High Ductility Nanostructured intermetallics with an average grain size of 99 nm were fabricated by annealing Hiperco Alloy 50HS at 438° C. in a hydrogen atmosphere for five hours (FIG. 3). Fractographic studies show that the dominant fracture mode for the fabricated nanostructured intermetallics is ductile with submicron dimples (FIG. 4).

EXAMPLE 4

Figure 6:
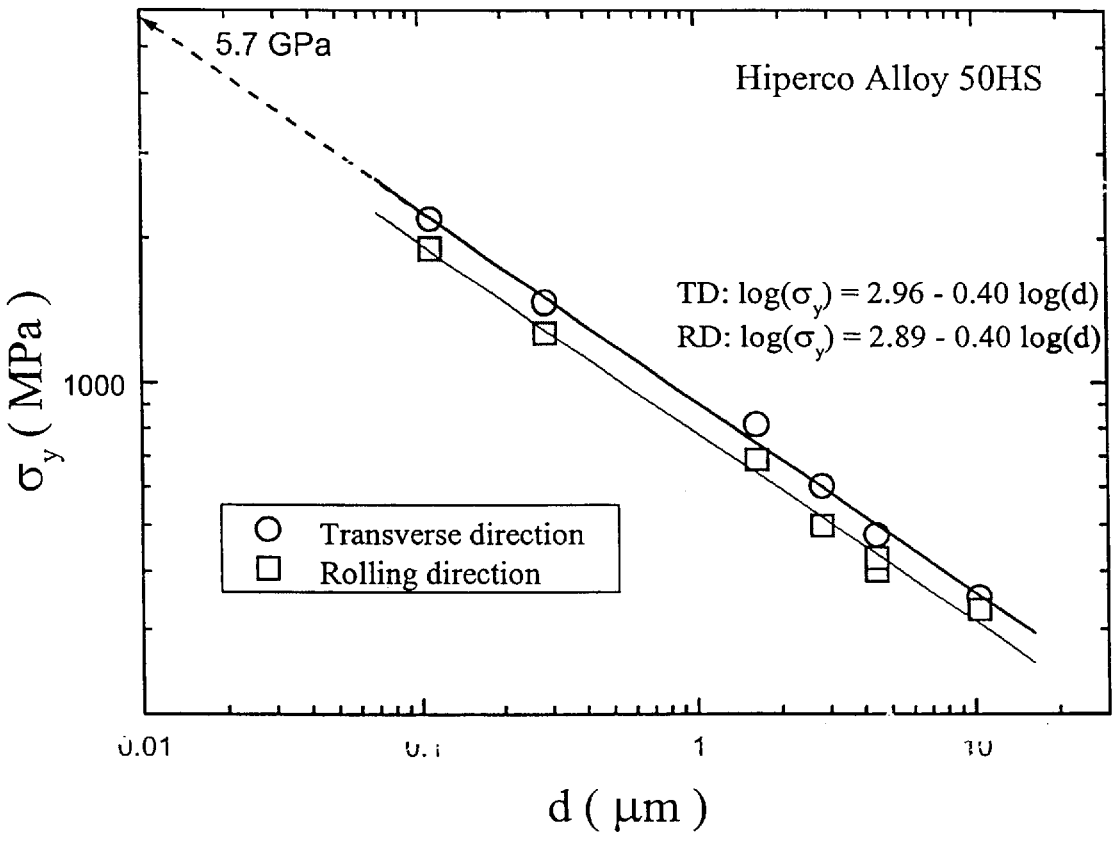
FIG. 6 demonstrates room temperature strengths versus grain size of Hiperco Alloy 50HS samples.
Figure 7:
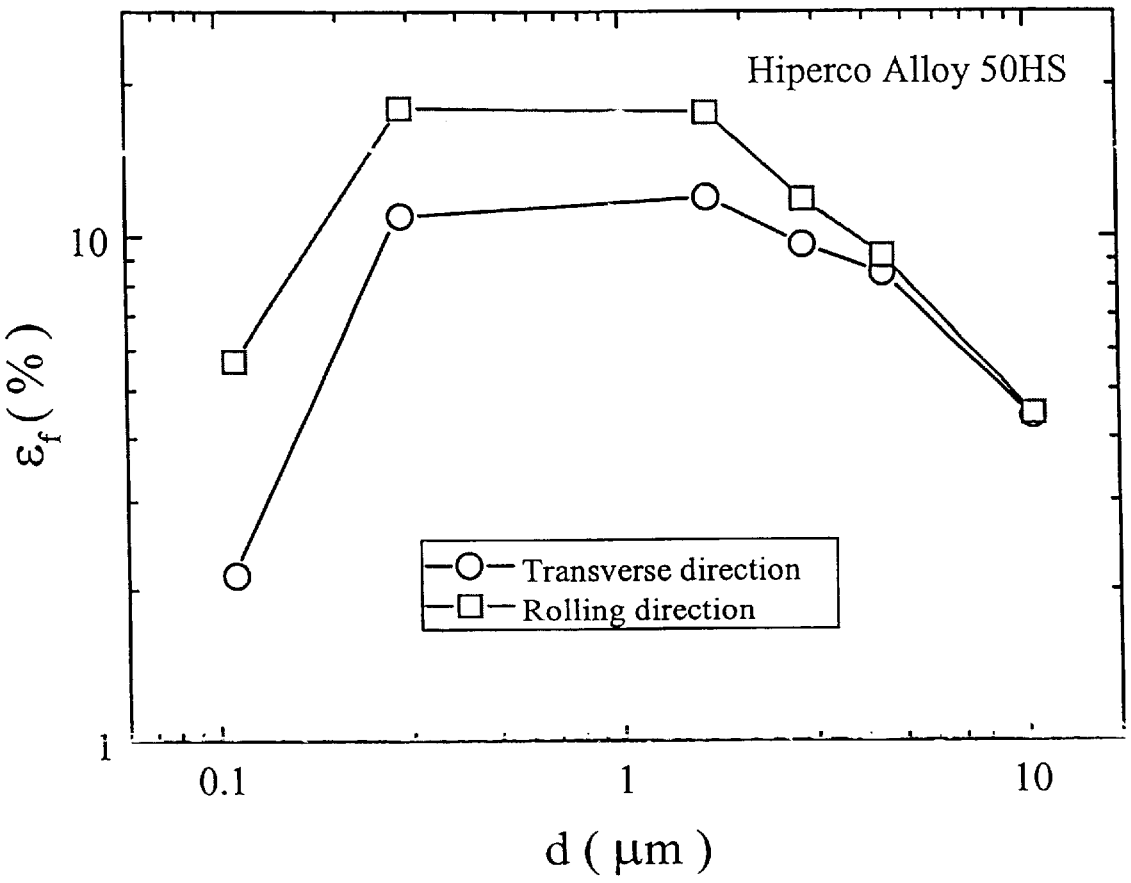
FIG. 7 shows room temperature ductility versus grain size of Hiperco Alloy 50HS samples.

Adjusting the Mechanical Properties of Nanostructured Materials by Varying Grain Size and Heat Treatment The mechanical properties of the nanostructured materials of the invention are adjusted by varying the grain size and heat treatment of the materials. Decreasing the grain size (i.e., through use of a lower annealing temperature) increases the tensile strength and decreases the ductility (FIGS. 5 and 6). In contrast, increasing the grain size (i.e., through use of a higher annealing temperature), decreases tensile strength while increasing ductility (FIGS. 5 and 6). The lower yield tensile strengths follow a similar Hall-Petch relationship, whether samples are strained in the rolling or the transverse directions, with a slope of about 0.4 (FIG. 6). The ductility shows a peak around 500 nm, and decreases with reducing grain sizes (FIG. 7). The lowest ductility observed, about 1.3% plastic strain-to-failure, is significantly larger than that of as-rolled materials, and much larger than any other reported values for nanostructured intermetallics made by other methods.

EXAMPLE 5

Vickers Hardness on the Nanostructured Materials

Figure 8:
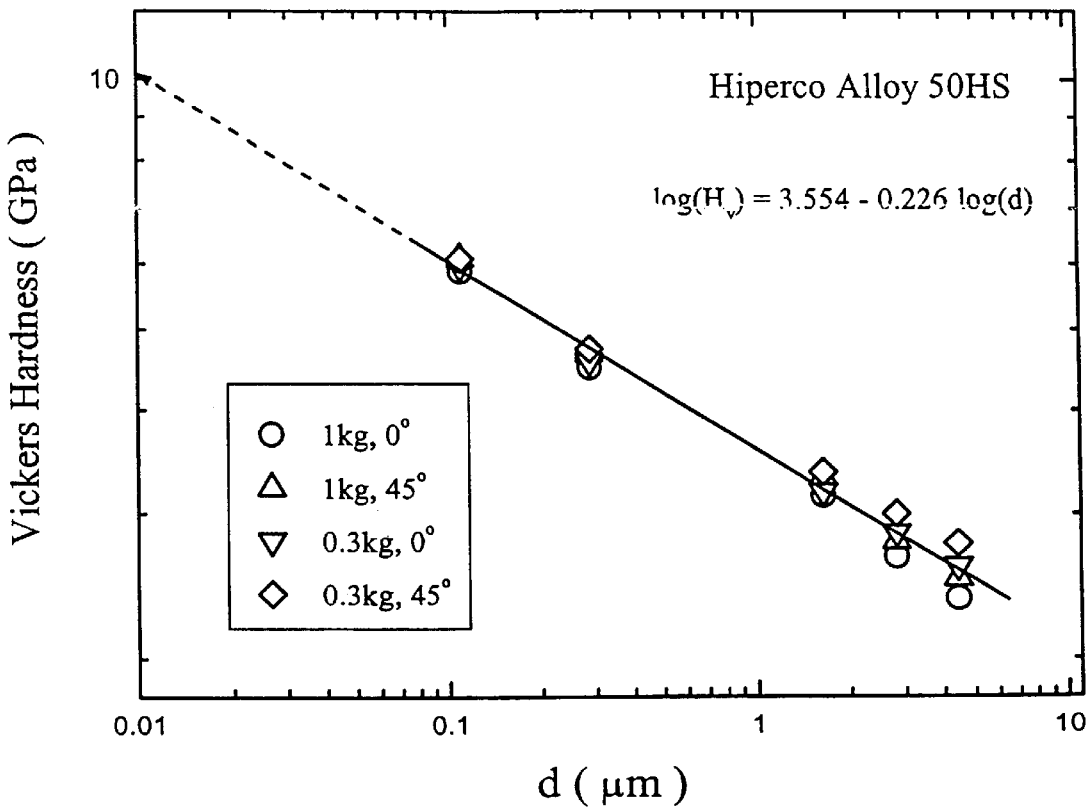
FIG. 8 shows Vickers hardness versus grain size for FeCo-based intermetallics.
Figure 9:
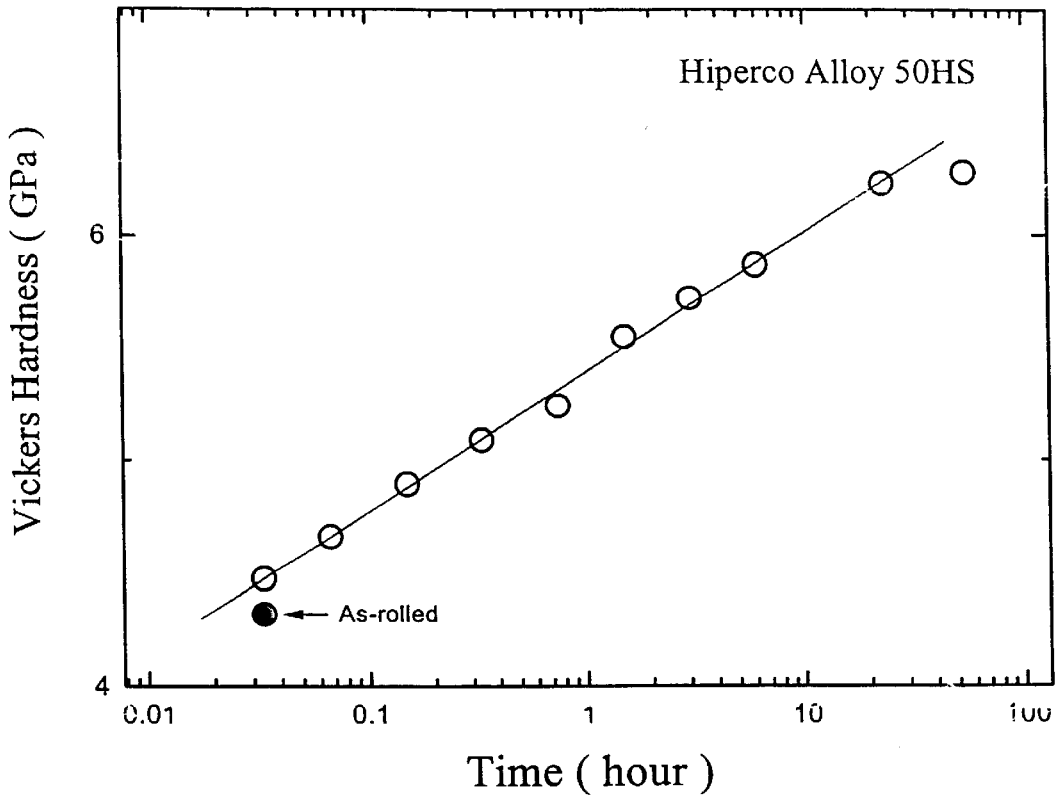
FIG. 9 shows Vickers hardness as a function of annealing time for Hiperco Alloy 50HS

The hardness of the samples was measured on a LECO microhardness tester (M-400) with Vickers indents (FIG. 8). At a temperature within the major recovery and recrystallization process, the Vickers hardness was found to increase logarithmically with the annealing time (FIG. 9), suggesting that the degree of recrystallization and grain growth increases with time at a fixed annealing temperature.

EXAMPLE 6

Additional Nanostructured Materials

The methods described in EXAMPLES 1–4 are applied to an a FeCo-based alloy consisting essentially of 48.78% cobalt, 1.92% vanadium, 0.05–0.31% niobium, 0.012% carbon, 0.1% nickel, balanced with iron cold-rolled to a reduction percentage of about 82.7% in thickness.

While preferred embodiments of the invention have been described and illustrated, it should be apparent that many modifications to the embodiments and implementations of the invention can be made without departing from the spirit or scope of the invention. While the illustrated embodiments have been described utilizing a cold-rolling and controlled annealing process to produce nanostructured materials of high tensile yield strength and high ductility, it should be readily apparent that other processes may be utilized (or steps added to the processes) to produce the unique nanostructured materials in accordance with the invention. Any form of plastic deformation, particularly a shape-changing process (e.g., forging, swagging, extrusion etc.), that results in the generation of numerous dislocation structures within existing grains may be utilized. To facilitate formation of fully dense ingots, the starting materials may be melted into a liquid state by vacuum induction melting or other suitable techniques, including vacuum-based resistive furnaces, electron beam melting, reduced atmosphere melting, etc.

Although the use of Hiperco Alloys has been described in detail, it should be apparent that any other intermetallic compound (or other metallic starting material) may be utilized in implementing the invention. Although the preferred embodiments have been described in particular application to bulk materials, it should be readily apparent that the invention may be applied to any number of other applications without departing from the scope of the invention.

Accordingly, the invention is not limited by the foregoing description, drawings, or specific examples enumerated herein, but only by the appended claims.

What is claimed:

1. A nanostructure material having a tensile yield strength from at least about 1.5 to about 2.3 GPa and a ductility of from at least about 1 to about 18 percent strain-to-failure, wherein the material consists essentially of about 0.003% to about 0.02% C, no more than about 0.10% Mn, no more than about 0.10% Si, no more than about 0.01% P, no more than about 0.003% S, no more than about 0.1% Cr, no more than about 0.2% Ni, no more than about 0.1% Mo, from about 48 to about 50% Co, from about 1.8 to about 2.2% V, from about 0.03 to about 0.5% Nb, no more than about 0.004% N, and no more than 0.006% O, and iron as the balance.

2. The nanostructured material of claim 1, further comprising microstructures with a grain size ranging from about 10 nanometers to about 900 nanometers.

3. The nanostructured material of claim 1, further comprising microstructures with a grain size of at least 10 nanometers.

4. A nanostructured material having a tensile elastic yield strain of at least about 1% for the material and a ductility from at least about 1 to about 18 percent plastic strain-to-failure.

5. The nanostructured material of claim 1, wherein said ductility is from between 1.3 to about 5.5 percent plastic strain-to-failure.

6. The nanostructured material of claim 1, wherein said the nanostructured material has a Vicker's hardness from about 5.5 to about 10 GPa.

7. A method of making a nanostructured material comprising melting a metallic material into a liquid state, solidifying the material, deforming said metallic material wherein a plurality of dislocation cell structures are formed, annealing said metallic material at a temperature from about 0.3 to about 0.7 of its absolute melting temperature, and cooling said metallic material to produce nanostructured material having a tensile elastic yield strain of at least about 1% for the material and a ductility of at least about 1 percent plastic strain-to-failure.

8. The method of claim 7, wherein said temperature is from about 0.37–0.53 of its absolute melting temperature.

9. The method of claim 7, wherein said temperature is from about 0.39 to about 0.44 of its absolute melting temperature.

10. The method of claim 7, wherein said temperature is at least about 350 degrees Celsius.

11. A method of adjusting the tensile strength of a nanostructured material comprising:

melting a metallic material into a liquid state;

solidifying said material;

deforming said metallic material wherein a plurality of dislocation cell structures are formed;

annealing said metallic material at a temperature from about 0.30 to 0.70 of its absolute melting temperature for a time from about 1000 hours to several seconds, wherein the temperature and time are selected to achieve a tensile elastic yield strain of at least about 1% for the material for said the nanostructured material; and cooling said metallic material.

12. A method of adjusting the ductility of a nanostructured crystalline material comprising the steps of:

melting a metallic material into a liquid state;

solidifying said material;

deforming said metallic material so that a plurality of dislocation cell structures are formed;

annealing said metallic material at a temperature from about 0.37 to 0.53 of its absolute melting temperature for a period of time from 50 hours to several minutes, wherein the temperature and time are selected to achieve a ductility from at least about 1% percent to about 18 percent plastic strain-to-failure; and cooling said metallic material after said annealing step.

13. A method of adjusting the ductility of a nanostructured crystalline material comprising the steps of:

melting a metallic material into a liquid state;

solidifying said material;

deforming said metallic material so that a plurality of dislocation cell structures are formed;

annealing said metallic material at a temperature from about 0.39 to about 0.44 of its absolute melting temperature for a period of time from about 20 hours to about 1 hour, wherein the temperature and time are selected to achieve a ductility from at least about 1% to about 18 percent plastic strain-to-failure; and cooling said metallic material after said annealing step.

14. The method of claim 11 wherein said deforming step further comprises cold rolling said metallic material with a thickness reduction ratio from about 50% to about 95%.

15. The method of claim 14 herein said thickness reduction ratio is at least about 90%.

16. The method of claim 14 wherein said thickness reduction ratio is at least about 80%.

17. Nanostructured magnetic materials, wherein the materials are cold-rolled and annealed at a temperature ranging from about 350 to about 705 degrees Celsius, have a room temperature yield strength from 1.2 GPa to more than 2.3

GPa, and tensile ductility from 1% to more than 18% plastic strain-to-failure;

wherein the material consists essentially of about 0.003% to about 0.02%C, no more than about 0.10% Mn, no more than about 0.10% Si, no more than about 0.01% P, no more than about 0.003% S, no more than about 0.1% Cr, no more than about 0.2% Ni, no more than about 0.1% Mo, from about 48 to about 50% Co, from about 1.8 to about 2.2% V, from about 0.03 to about 0.5% Nb, no more than about 0.004% N, and no more than 0.006% O, and iron as the balance.

18. Nanostructured magnetic materials, wherein the materials are cold-rolled and annealed at a temperature ranging from about 350 to about 705 degrees Celsius, have a room temperature yield strength from 1.2 GPa to more than 2.3 GPa, and tensile ductility from 1% to more than 18% plastic strain-to-failure;

wherein said materials consist essentially of 48.78% cobalt, 1.92% vanadium, 0.06% niobium, 0.012% carbon, 0.1% nickel, balanced with iron.

* * * * *